United States Patent [19]

Vole

[11] Patent Number: 4,819,551

[45] Date of Patent: Apr. 11, 1989

[54] SAFETY SYSTEM FOR SMOKE AND FUMES

[76] Inventor: John Vole, 600 Avon Cts., Vernon Hills, Ill. 60061

[21] Appl. No.: 140,579

[22] Filed: Jan. 4, 1988

[51] Int. Cl.[4] ..... F24F 7/013; E05F 15/20

[52] U.S. Cl. ..... 98/42.04; 98/33.1; 49/31; 340/632

[58] Field of Search ..... 236/49; 49/31; 98/42.04, 49, 33.1; 340/632, 633, 634

[56] References Cited

U.S. PATENT DOCUMENTS 3,635,282 1/1972 Watanabe ..... 236/49
4,197,675 4/1980 Kelly ..... 49/31
4,257,319 3/1981 Kucharczyk ..... 98/37
4,338,526 7/1982 Martin et al. ..... 49/31

FOREIGN PATENT DOCUMENTS 0077636 6/1981 Japan ..... 98/40.04

*Primary Examiner*—Harry B. Tanner
*Attorney, Agent, or Firm*—Paul H. Gallagher

[57] ABSTRACT

A detector unit, for detecting fumes, including carbon monoxide, is located in a garage, and circuitry controlled thereby automatically opens the garage door, or operates an exhaust blower, or both. The door remains open, or the exhaust blower continues operating, or both, until the circuitry is manually reset.

5 Claims, 2 Drawing Sheets

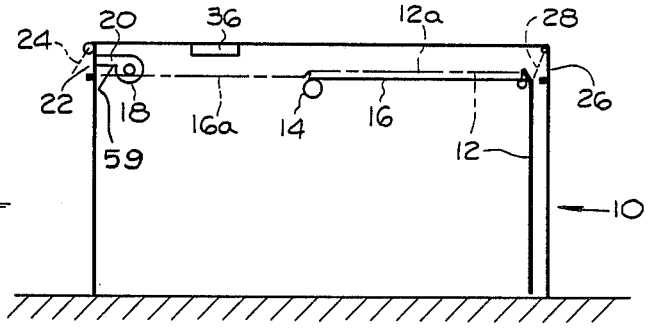
Fig. 1
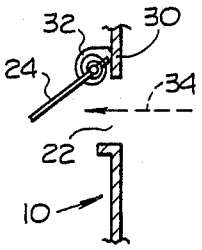
Fig. 2
Fig. 3
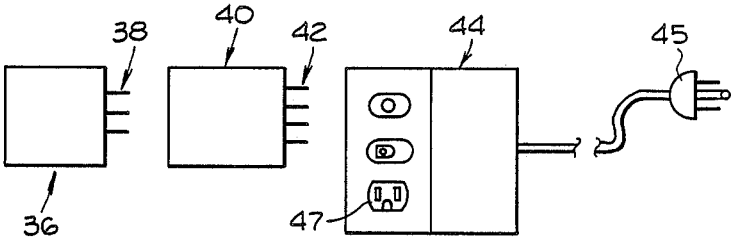
Fig. 4
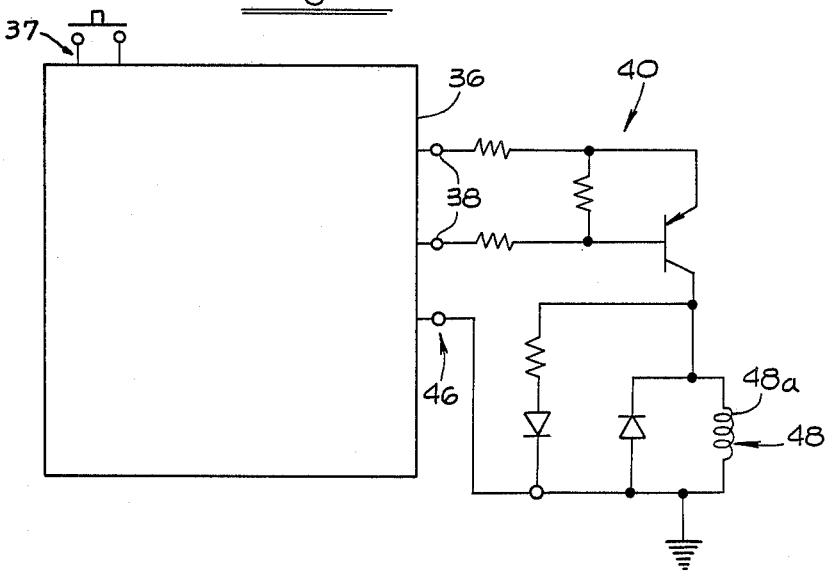

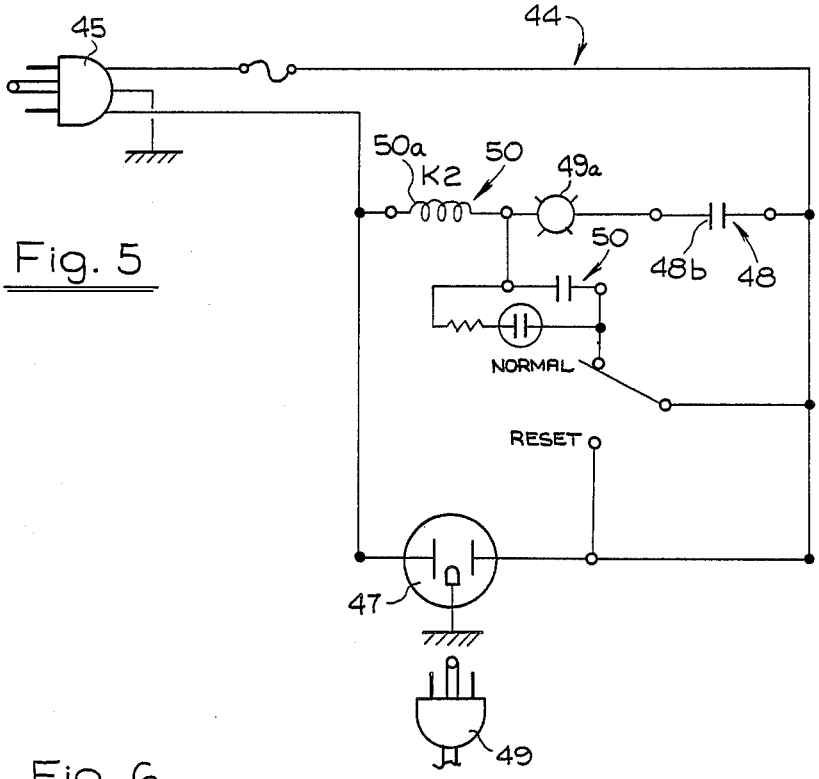
Fig. 5
Fig. 6
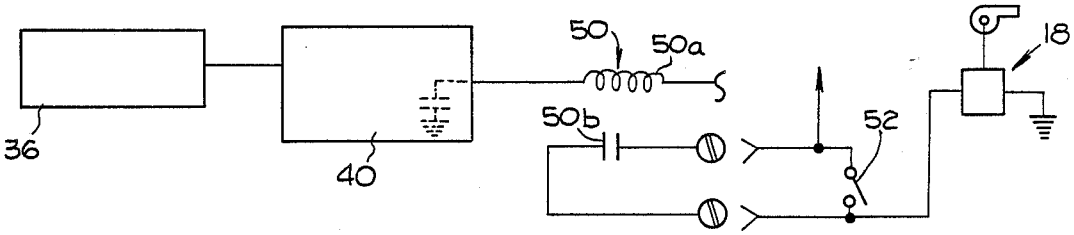
Fig. 7
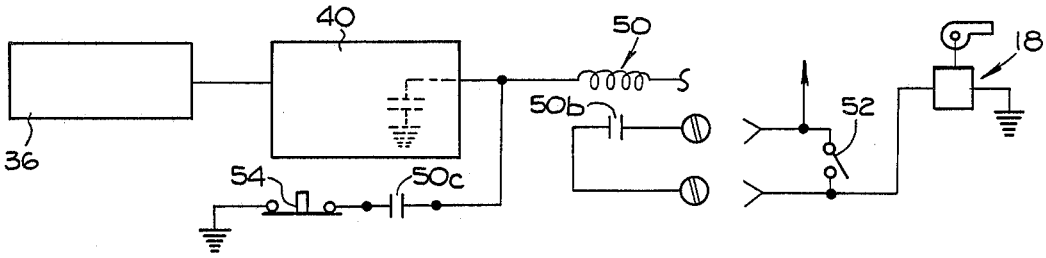
Fig. 8
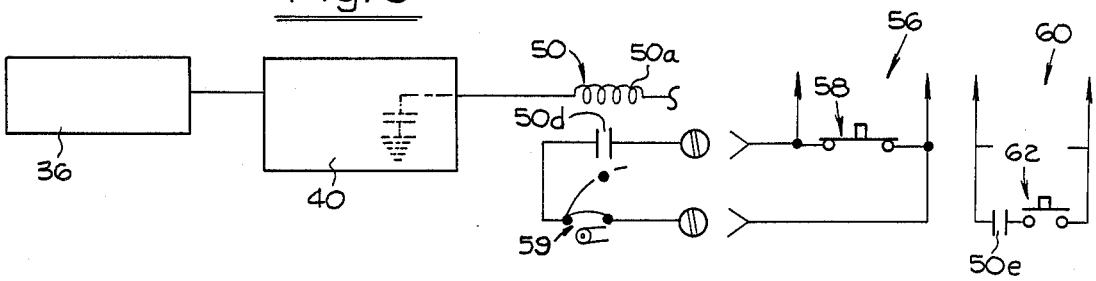

SAFETY SYSTEM FOR SMOKE AND FUMES

FIELD OF THE INVENTION

The invention resides in the field of safety protection against smoke and fumes. A well known instance where danger exists in connection with smoke and fumes as in the case of automobiles. Accumulation of carbon monoxide many times occurs in the garage where the automobile is placed, and the user is endangered thereby in so placing it, or in removing it therefrom. A common habit is to leave the automobile running to warm it up, before removing it from the garage, resulting in accumulation of carbon monoxide. Another danger exists in the carbon monoxide escaping through the cracks in the garage structure and into enclosed spaces that may be adjacent or above the garage.

OBJECTS OF THE INVENTION

A broad object of the invention is to provide safety apparatus that responds to dangerous fumes, and thereupon automatically encounters the dangerous condition.

Another and more specific object is to provide apparatus of the character referred to, particularly useful in the case of a closed space in which fumes can accumulate, and in such case, is effective for exhausting the fumes from the space, or opening the space to the exterior, or both.

Still another object is to provide such apparatus particularly effective in the case of a homeowner's garage, where many times the owner is alone in driving the automobile into the garage and removing it therefrom, and consequently without someone there to report to others about danger or a casualty.

DESCRIPTION OF A PREFERRED EMBODIMENT

In the drawings,

FIG. 1 is a diagrammatic view of a garage having a door, in which the device of the present invention is installed.

FIG. 2 is a detailed view of an air vent in the garage.

FIG. 3 is a diagrammatic illustration of the electrical components utilized in the device.

FIG. 4 is a diagram of an interface circuit utilized between a fumes detector and electrical operating component.

FIG. 5 is a diagram of a portion of the electrical circuit utilized in the apparatus.

FIG. 6 is a diagram of another electrical component.

FIG. 7 is a diagram of still another electrical component.

FIG. 8 is a diagram of an additional electrical component.

As referred to above, the device of the invention is particularly applicable to situations where fumes develop, a most common example of which is a garage for an automobile or car.

Such a garage is indicated at 10 in FIG. 1 and has the usual door 12 which in the present case, moves between a down or closed position, as indicated in full lines, and an upper or open position, as indicated in dot-dash lines. The door is operated by a power unit or driver 14 which includes an electrical motor and a rigid driver link 16. The door may be operated in any suitable arrangement, such for example as in which the power unit 14 may include an electrical motor and a pinion, and the link 16 a rack. The door may be closed by driving the rigid link 16 and pushing it closed, or an alternative arrangement is to utilize the power unit only to open the door, and a spring to close it. In the opening operation the link 16 is moved back to a position shown at **16*a***, pulling the door to open position. The arrangement includes an electrical control circuit as will be referred to again hereinbelow. The control and the operation or drive for moving the door between its closed and open positions may be of conventional kind.

The invention includes means for exhausting fumes or smoke from the garage, which may include a blower 18 having an exhaust conduit 20 leading to the exterior. The outlet 20 leads through an opening 22 normally closed by an outer flap door 24. The opening 22 may be at one end of the garage and it may be desired to have a similar opening 26 at the opposite end, closed by a flap door 28 on the inside. This opening 26 will be referred to again in connection with the main opening of the garage covered by the door 12.

FIG. 2 shows a flap door, e.g., 24, mounted on a fixed element 30 on the garage and biased downwardly to closed position by a coil spring 32, but yielding to let the air flow through as indicated by the dotted line arrow 34.

As set out above, the apparatus of the invention incorporates means responsive to the accumulation of fumes in the garage. Such devices are now known, and often are referred to as smoke detectors although similar devices respond to the presence of fumes and particularly carbon monoxide. They are arranged so that upon the concentration of the fumes reaching a certain level, they produce a signal which is often translated to a visual light signal or a sound signal, or both, and in the present case such electrical signal is utilized for controlling electrical components for exhausting the fumes from the garage. The steps involved in so exhausting the fumes include opening the main garage door, or operating an exhaust blower, or both.

Referring to the electrical circuit for controlling the apparatus, attention is first directed to FIG. 3 which includes a detector unit 36, of known kind as indicated above, which detects the carbon monoxide fumes. The detector unit may include a self-contained power source, such as a battery, or a main line source, as desired, and has a test switch component 37, shown diagrammatically. The unit includes output conductors 38 as part of its standard design, and in the present arrangement, these conductors are utilized in a further unit 40 of the apparatus which includes an interface circuit. The output conductors of the interface circuit are indicated at 42 which lead to an output control component 44.

The component 44 is also shown in FIG. 5, which includes a connector plug 45 which is plugged into a main AC source. The component 44 also includes a connector socket 47 into which is inserted a connector plug 49 in the circuit that is already supplied in the garage for operating the main garage door, or the exhaust blower, or both.

The detector unit 36 is mounted in the interior of the garage (FIG. 1) and upon the fumes reaching a predetermined concentration, a signal is produced at the output 46 (FIG. 4) and this signal energizes the relay coil **48*a* of a relay 48, (FIG. 5) and turns on a light 49. This relay includes contacts 48*b* and upon consequent closing of those contacts, a relay 50** is energized. The coil 50*a* of the relay is shown in FIG. 5 and the complete relay is shown in FIGS. 6–8 as will be referred to again hereinbelow.

FIG. 6 shows an electrical circuit component constituting one form of the practical installation of the device. This component includes the detector unit 36, the interface circuit 40, and the relay 50, the latter including the coil 50*a* and a first set of contacts 50*b*. Upon a signal given by the detector unit 38, the relay coil 50*a* is energized, closing the normally open contacts 50*b*, and completing a circuit to the exhaust blower 18. The circuitry may include a manual switch 52, for convenience, but upon connecting the blower through the contacts 50*b* the blower continues operating until the detector unit 36 clears, i.e. the fumes are exhausted from the garage to a safe level.

FIG. 7 shows an arrangement similar to that of FIG. 6, and includes an additional set of contacts 50*c* of the relay 50 and a reset switch 54 in series with the contacts 50*c*. The contacts 50*c* are latched closed upon energization of the relay and the circuit to the blower remains closed until it is opened by actuating the reset switch 54. This is an extra safety precaution, requiring the attention of the user to turn off the blower manually to assure the blower running for a substantial period of time.

FIG. 8 shows a circuit component for controlling the operation of the main garage door 12. This circuit component includes the relay 50 and a set of contacts 50*d*, and an output control segment 56 for controlling the driver 14 (FIG. 1) for opening the door. Upon a signal given by the detector unit 36 in response to a concentration of fumes, the output electrical signal energizes the relay 50 and closes the contacts 50*d* and closes circuit to the door opener control segment 56. The numeral 58 indicates a manual switch provided in the standard arrangement for operating the door. Upon the door reaching open position (FIG. 1) it engages a switch 59 and opens it (FIG. 8), disabling the circuit to the driver 14. Upon the door being closed by other controls (10, FIG. 8), the switch 59 closes.

The component of FIG. 8 includes a control indicated diagrammatically at 60 for closing the door 12 according to the arrangement in the standard circuitry. Such closing step is normally performed at some period of time after its opening, determined by other conditions. The circuit of the means 60 includes normally open contacts 50*e* that are latched closed upon energization of the coil 50*a*, shorting the door closing control 60, and the door thereby remains open, until the contacts 50*e* are opened by a manual reset switch 62. Consequently, the means for reclosing the door is disabled and remains disabled until the user later enables it, in a deliberate operation, thus assuring that the door remains open as long as there is any danger existing.

Normally it is desired that in all cases of fumes collecting, the main door 12 of the garage be open, providing great access to inflow of air. Thereupon the operation of the exhaust blower 18 easily exhausts the garage through the opening 22. However it may be desired that instead of having the door 12 open, the blower 18 may be operated, drawing air in through the opening 26, while the door 12 remains closed.

I claim:

1. Safety apparatus for use in a space in an enclosure in which fumes occur and tend to accumulate, wherein the enclosure has a closer capable of being opened for providing a closable opening from the space to the exterior, electrically operated power means for moving the closer between open and closed positions, and an electrical circuit for operating the power means, comprising, electrically operated exhaust means for exhausting gas from said space, a detector unit in said space capable of detecting fumes of a predetermined concentration, and in response thereto producing an electrical signal of relatively low voltage, the electrical circuit including first control means operable in response to production of said electrical signal for operating said power means and moving the closer to open position, and constantly holding it in that position until the electrical circuit is activated in a reset step, the electrical circuit including second control means operable in response to production of a said electrical signal for operating said exhaust means, and constantly holding it in operating condition until the electrical circuit is activated in a reset step, and manually activated reset means for placing the electrical circuit in the condition it assumed before production of said electrical signal.

2. Safety apparatus according to claim 1 and including, a signal light normally in off condition, the electrical circuit including third control means operable in response to production of a said electrical signal for turning on said signal light and constantly holding it on until the electrical circuit is activated in a reset step, said manually actuated reset means being operable also for effecting turning off of the signal light.

3. Safety apparatus according to claim 1, and including means for establishing gas passages into and out of said space respectively, for enabling change of gas in said space independently of the position of said closer.

4. Safety apparatus according to claim 3 wherein, the last named means for establishing gas passages includes openings normally closed by flap doors biased to closed position but yielding to open position by air pressure in response to operation of the exhaust means.

5. Safety apparatus according to claim 1 wherein the enclosure includes means for controlling the power means rendering it operable, after a period of time following moving of the door to open position, for again moving it to closed position, and wherein, said first control means is operable for holding the closer against movement to closed position as stated, independently of, and beyond the expiration of said period of time, and the reset means is operable for conditioning the electrical circuit for effecting movement of the closer to closed position.

* * * * *